US006739499B1

(12) United States Patent
Bachner

(10) Patent No.: US 6,739,499 B1
(45) **Date of Patent: *May 25, 2004**

(54) METHOD AND APPARATUS FOR FORMING A STABLE CONTAINER BOTTOM

(75) Inventor: Jerry G. Bachner, Algonquin, IL (US)

(73) Assignee: Nimco Corporation, Crystal Lake, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/876,693

(22) Filed: Jun. 11, 1997

(51) Int. Cl.[7] ..... B65D 5/06

(52) U.S. Cl. ..... 229/104; 229/125.42; 229/915.1; 229/184

(58) Field of Search ..... 229/104, 125.42, 229/915.1, 184

(56) References Cited

U.S. PATENT DOCUMENTS

| | | | | | |
|---|---|---|---|---|---|
| 512,571 | A | * | 1/1894 | Walker | 229/104 |
| 3,339,821 | A | | 9/1967 | Wojcik | |
| 3,586,232 | A | * | 6/1971 | Scully | 229/104 X |
| 3,712,844 | A | * | 1/1973 | Ratten et al. | 229/5.5 |
| 3,971,300 | A | * | 7/1976 | Bachner | 229/138 X |
| 4,093,115 | A | | 6/1978 | Bachner et al. | |
| 4,601,425 | A | | 7/1986 | Bachner | |
| 4,702,410 | A | | 10/1987 | Derving | |
| 4,838,847 | A | * | 6/1989 | Kume et al. | 493/133 |
| 4,861,328 | A | | 8/1989 | Franke et al. | |
| 4,991,768 | A | * | 2/1991 | Kondo | 229/137 |
| 5,029,751 | A | | 7/1991 | Detzel | |
| 5,056,707 | A | * | 10/1991 | Larsen | 229/104 |
| 5,078,315 | A | | 1/1992 | Floberg | |
| 5,135,463 | A | | 8/1992 | Hyduk | |
| 5,222,667 | A | | 6/1993 | Fujikawa et al. | |
| 5,324,250 | A | | 6/1994 | Janson et al. | |
| 5,337,538 | A | | 8/1994 | Ljungstrom | |
| 5,474,232 | A | * | 12/1995 | Ljungstrom et al. | 229/137 |
| 5,482,204 | A | * | 1/1996 | Mills et al. | 229/104 |
| 5,564,255 | A | | 10/1996 | Giacomelli | |
| 5,725,144 | A | * | 3/1998 | Stone et al. | 229/104 X |
| 5,738,272 | A | * | 4/1998 | Anchor et al. | 229/109 X |
| 5,765,746 | A | * | 6/1998 | Peasley et al. | 229/104 |
| 5,845,840 | A | * | 12/1998 | Johansson et al. | 229/104 |
| 5,871,144 | A | * | 2/1999 | Anchor et al. | 229/109 |

FOREIGN PATENT DOCUMENTS

| | | |
|---|---|---|
| EP | 0582003 A1 | 2/1994 |
| GB | 610744 | 10/1948 |

OTHER PUBLICATIONS

The Wiley Encyclopedia, p. 150, 1986.*
Webster's New World Dictionary, 3rd College edition, 1988.*

* cited by examiner

*Primary Examiner*—Tri M. Mai
(74) *Attorney, Agent, or Firm*—Jenner & Block LLP

(57) ABSTRACT

An apparatus and corresponding method for contouring a container bottom to form carton legs from a standard carton blank through the use of a seal plate and a mandrel pad. The carton legs provide improved free standing stability of the carton.

5 Claims, 6 Drawing Sheets

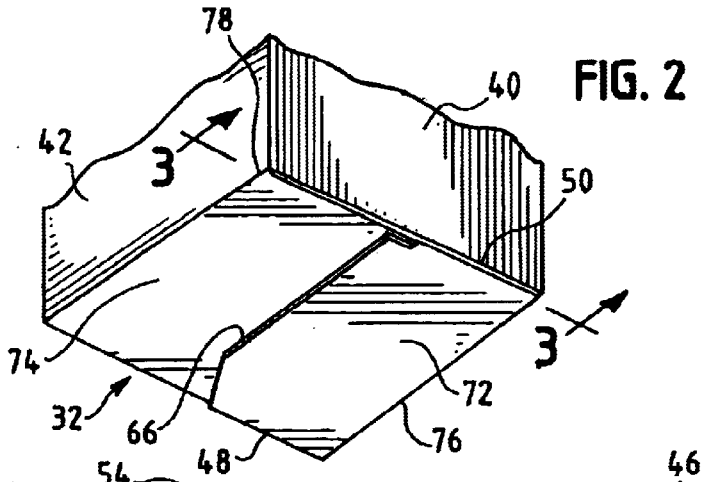
FIG. 2
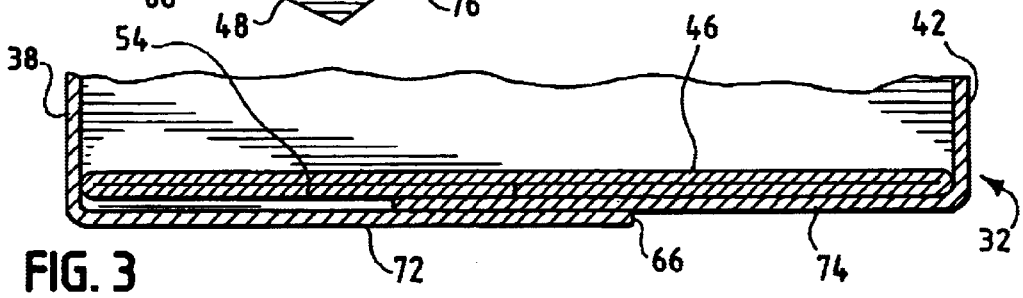
FIG. 3
FIG. 3A
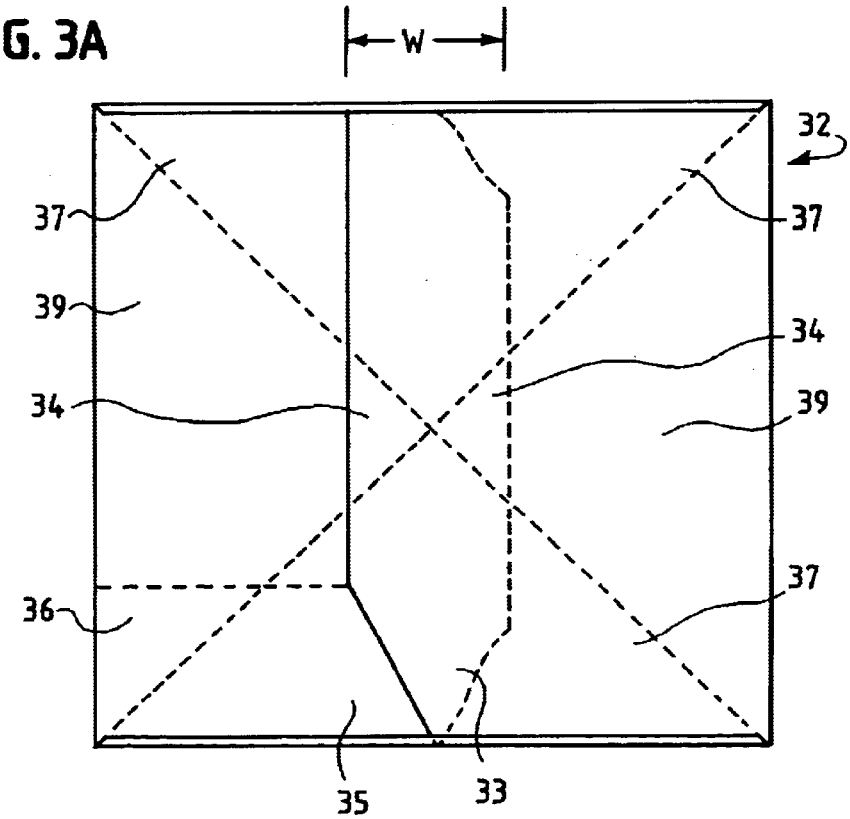

FIG. 4
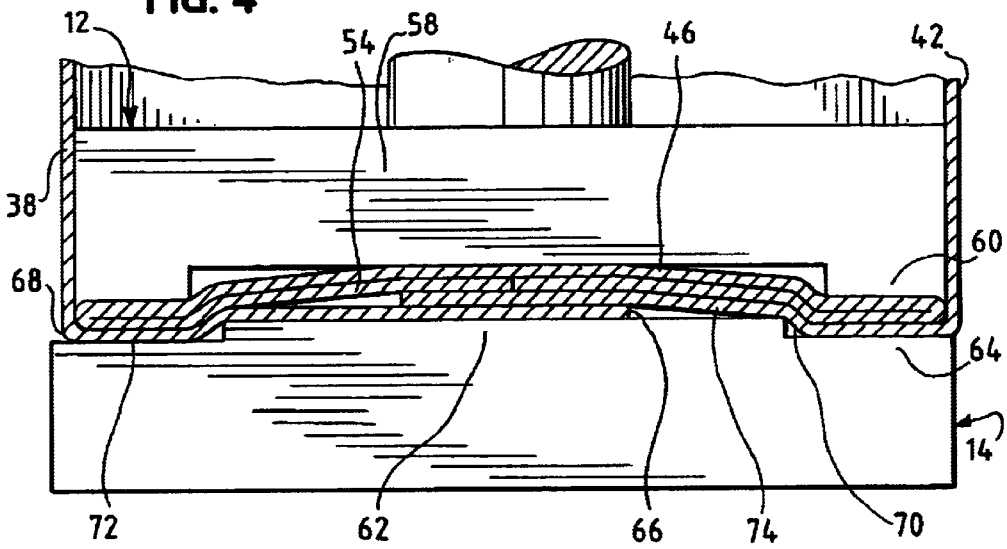
FIG. 5
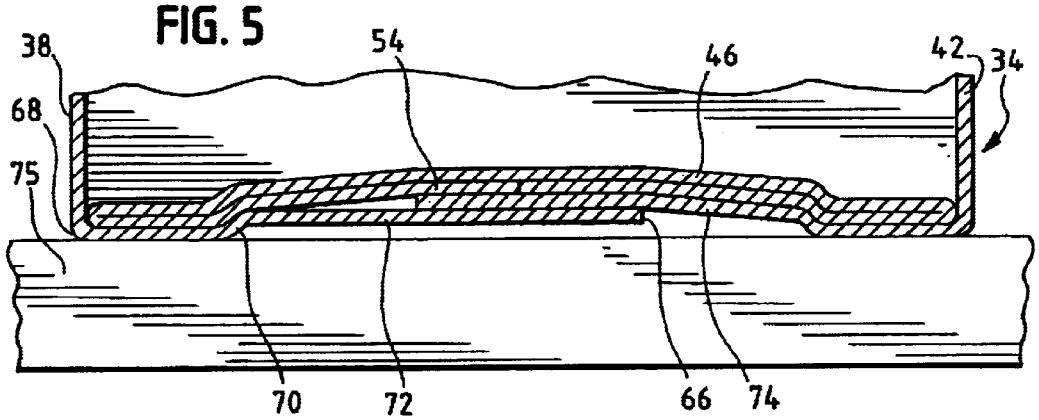
FIG. 6
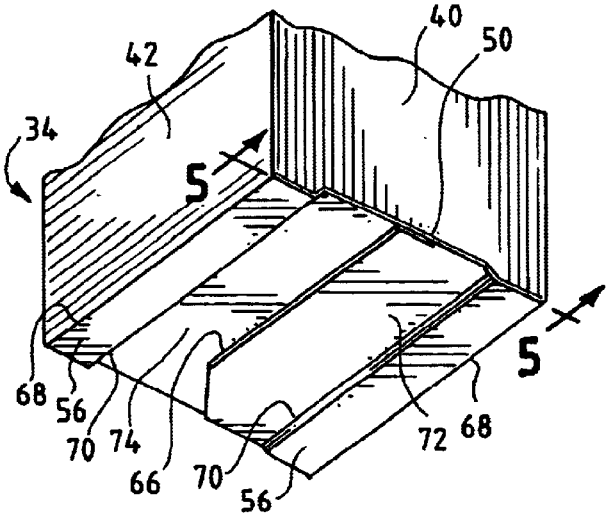
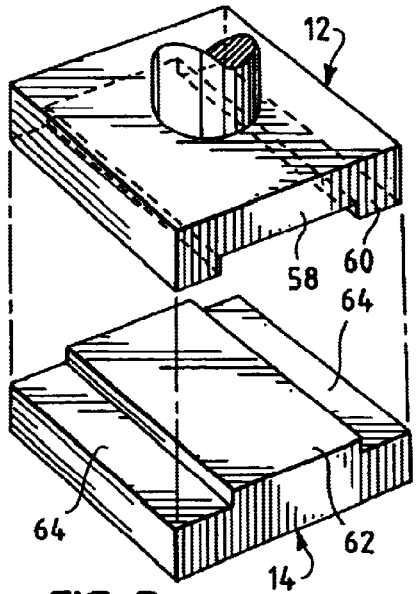
FIG. 7

METHOD AND APPARATUS FOR FORMING A STABLE CONTAINER BOTTOM

FIELD OF THE INVENTION

The invention relates to manufacturing containers, and in particular to an apparatus and method for contouring a stable bottom for cartons or boxes such as paperboard cartons used for holding liquids, powders and the like, and to containers so contoured.

BACKGROUND OF THE INVENTION

An example of one common and useful type of container is the paperboard carton having a square cross-section and a gabled top. Examples of such cartons include the everyday milk carton. In recent years, these cartons have been used for numerous other products, including, for example, foods, beverages and detergents. These cartons are typically coated or laminated with a heat-sealable plastic or other suitable material, which is used by manufacturers to seal the cartons.

The bottoms of such paperboard cartons, as well as other types of paperboard or cardboard containers, often are uneven, rather than perfectly flat, making them unstable. That is, rather than standing perfectly upright, the carton rests in a slightly tilted position when placed in the upright position on a flat surface. Furthermore, the carton may rock to a different tilted position if bumped or moved. This rocking and tilting is undesirable to consumers, wholesalers, transporters, grocers and other merchants and distributors of goods packaged in such cartons. This instability typically results from a natural bulge in the carton bottom due to pressure exerted by the product inside and/or discontinuities on the bottom exterior surface formed by overlapping, folded layers within the carton bottom.

Currently, there are several methods to minimize the effects of the problem of instability caused by the bulge.

A carton disclosed in Ljungstrom, U.S. Pat. No. 5,474,232, issued in 1995, provides a concave carton bottom having an arcuate cross-section such that the carton rests on the bottom end of each of two opposing side walls. Col. 7, lines 10–12. This method, however, has the disadvantage that it requires a specially designed carton blank having curved, rather than straight, side creases. Most current carton forming machines are designed to operate with certain standard carton blanks. It can be expensive and inconvenient to procure non-standard carton blanks. It would be desirable to form a concave carton bottom with standard carton blanks.

A packaging machine disclosed in Kume et al., U.S. Pat. No. 4,838,847 which issued in 1989 provides a carton bottom with a substantially pyramidal recessed central cavity. Col. 3, lines 16–20; col. 3, lines 35–40. This carton bottom is supported by end surfaces on all four sides of the carton. This specific configuration is difficult to form, and increases the likelihood of liquids spilling from the carton during transport. A need exists for a simpler stable carton bottom which does not increase the risk of spillage.

A carton bottom sealer disclosed in Mills et al., U.S. Pat. No. 5,482,204 which issued in 1996 provides a carton bottom with a lenticular profile—i.e., a "concave, stepped pyramid formed into multiple tiers of lapped layers" as the profile of the carton bottom. Col. 1, lines 57–58. This carton bottom is formed from a standard carton blank and is intended to be more stable than a traditional carton bottom. However, the structure of the foregoing carton bottom has the disadvantage of being complicated.

Another effort to provide a stable bottom for a carton is described in Fujikawa et al., U.S. Pat. No. 5,222,667 issued in 1993. The '667 patent discloses forming a recess of inverted V-shaped cross section extending across the bottom closure through the center thereof, so that the recess diminishes the bulge of the bottom closure. The recess has a width approximately equal to the width of the striplike region (31 in FIG. 5 of the Fujikawa et al. patent) having four thicknesses of the container blank. See FIG. 5; col. 3, lines 30–37; col. 2, lines 50–56. Similarly, NiMCO Corporation of Crystal Lake, Ill., had previously provided packaging machines for making cartons having a bottom configuration of the type illustrated in FIG. 1A. In the prior art NiMCO container, the width of the recess also was limited to approximately the width of the center region having four overlapping layers, and the recess did not include the regions where there are fewer than four overlapping layers (i.e., on either side of the four-layer center region).

However, none of the foregoing bottom configurations satisfactorily solve the problem of instability resulting from a bulge in the carton bottom. Accordingly, there is a need for a more stable carton bottom than was provided by the prior art carton bottom configurations.

A need exists for an apparatus and method of forming a stable carton bottom from a standard carton blank which can be used with current carton forming machines. A need also exists for a carton bottom which is inexpensive to produce in current carton forming machines. Additionally, a need exists for providing a stable carton bottom on cartons with other than rectangular side panels, e.g., tapered cartons.

SUMMARY OF THE INVENTION

In accordance with the present invention, it has been discovered that forming the carton bottom so that selected regions of the carton bottom exterior surface extend below the surface of another region (i.e., a recessed region) of the carton bottom allows such selected regions to function as legs, thereby providing a more stable bottom structure than prior art methods. This is achieved by making the width of the recessed region wider than in certain of the prior art methods. In the preferred embodiment, the recessed region encompasses substantially the entire center portion of the bottom panel having the maximum number of overlapping layers as well as a substantial portion on either side of such center portion where there are fewer than the maximum number of overlapping layers. Providing such a wider recessed portion results in a marked improvement in carton stability over prior art methods, which had either a narrow center recess or which required either specially configured carton blanks or more complicated carton bottom configurations than the present invention.

In accordance with yet another aspect of the present invention, a stable carton with carton legs is formed from a standard carton blank. Because the present invention may be used with, among other things, a standard carton blank, current carton forming machines may be readily adapted to use the present invention.

Additionally, a standard carton blank is often less expensive and more readily available than a specially designed carton blank.

In accordance with yet another aspect of the present invention, a carton bottom is formed with a simple mechanism which can be readily incorporated into current carton forming machines. The present invention relates to a novel seal plate and mandrel pad which contour the carton bottom.

The present invention is advantageous because it easily and inexpensively can be adapted to and integrated into existing carton forming machines. For example, the sealing horn 22 and mandrel pad 40 of U.S. Pat. No. 3,971,300 or the pressure pad 118 and mandrel 120 of Hyduk, U.S. Pat. No. 5,135,463, as well as the horn and mandrel pad of other existing carton forming machines could be modified to incorporate the present invention.

In accordance with the present invention, a carton bottom is formed with improved stability. This improved stability is desirable for transportation, storage and display of the cartons to customers.

BRIEF DESCRIPTION OF THE DRAWINGS

FIG. 2 is a perspective view of the bottom of a sealed carton with respect to which the present invention has not been used;

FIG. 3 is a cross-sectional view of the sealed carton in FIG. 2 taken along line 3—3 of FIG. 2;

FIG. 3A is a diagram illustrating layers of the sealed carton bottom in FIG. 2;

FIG. 4 is a cross-sectional view of a mandrel pad, seal plate and stable carton bottom;

FIG. 5 is a cross-sectional view of the stable carton bottom in FIG. 6 taken along line 5—5 of FIG. 6 seated on a flat surface;

FIG. 6 is a perspective view of the stable carton bottom shown in FIG. 4;

FIG. 7 is a perspective view of the mandrel pad and seal plate shown in FIG. 4.

DETAILED DESCRIPTION OF THE INVENTION

Figure 1:
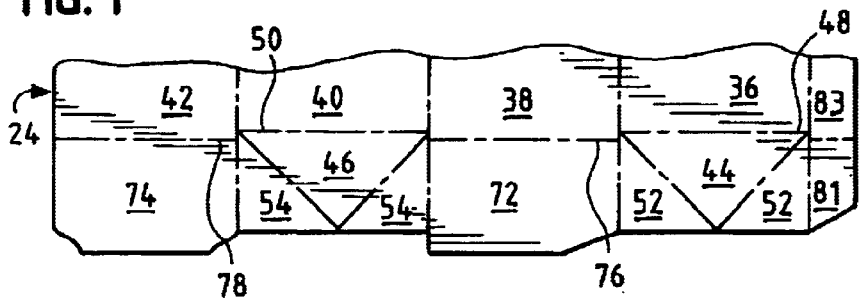
FIG. 1 is a top plan view of a lower portion of a standard paperboard carton blank suitable for use with the present invention.
Figure 1A:
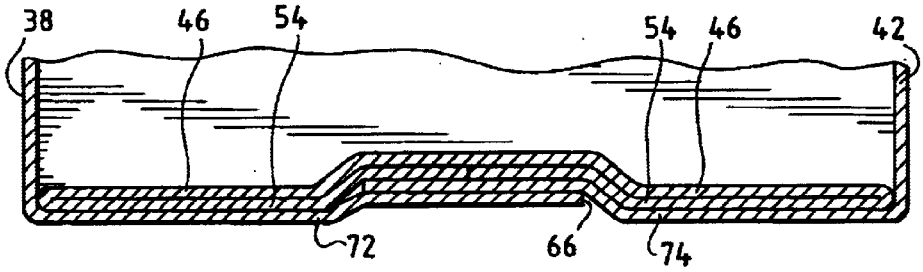
FIG. 1A PRIOR ART
FIG. 1A is a cross-sectional view of the bottom of a sealed carton previously used by NiMCO Corporation.

One embodiment of the present invention is suitable for use with, for example, paperboard cartons, as described in detail below. However, it should be understood that the present invention is suitable for use with cartons or containers produced from fiberboard, cardboard, or other materials of various sizes and configurations including, for example, beverage cups. Referring to the figures generally and particularly to FIG. 1, there is shown a top plan view of the bottom portion of a typical paperboard blank 24. Blank 24 is conventional, and for clarity is shown before being folded. Blank 24 is a single, continuous piece which can be folded to form a sealed carton.

In the preferred embodiment, the paperboard of blank 24 is laminated with heat-sealable plastic, as is well known. One side of the blank may also be laminated with barrier material such as metal or other material. The present invention can function with blanks utilizing any top closure configuration, such as with a gable top or a flat top similar to the sealed bottom surface.

Figure 1B:
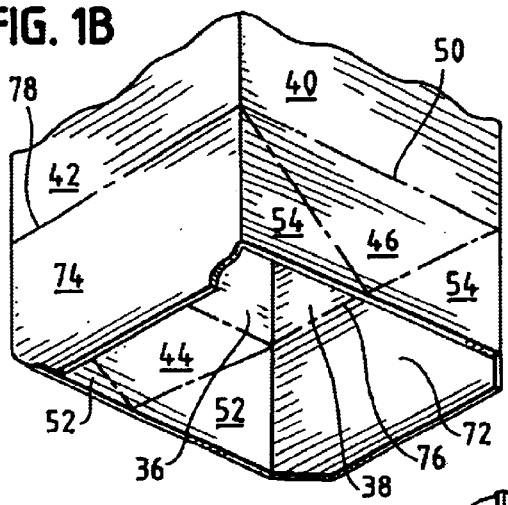
FIGS. 1B, 1C and 1D pictorially illustrate a typical bottom folding sequence of a paperboard container.
Figure 1C:
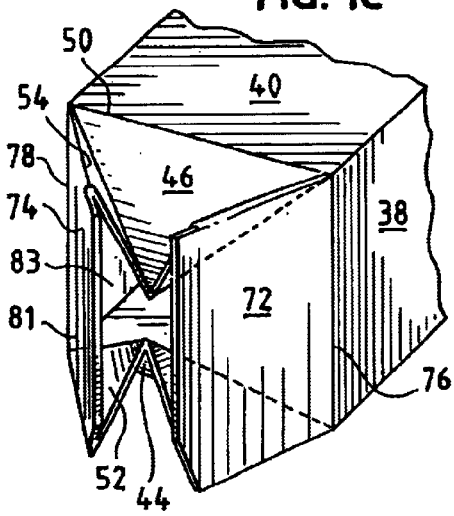
Figure 1D:
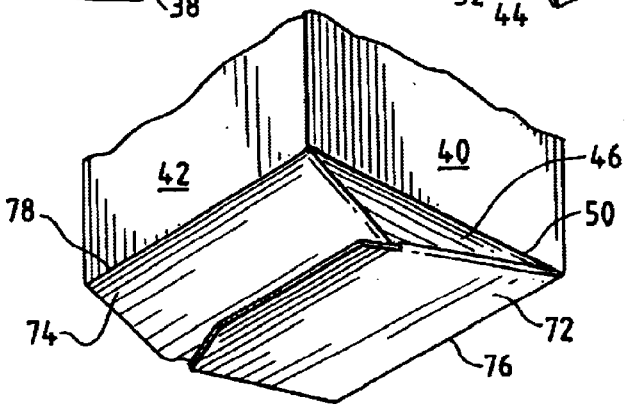

The folding sequence of blank 24 is illustrated by collective reference to FIGS. 1B, 1C and 1D. Initially blank 24 is folded, by any appropriate method, such that panels 36, 38, 40 and 42 form sidewalls of carton 32, with the top and bottom ends open. Mutually facing main bottom panels 72 and 74 then are partly folded towards one another along fold lines 76 and 78, respectively. At substantially the same time, triangular panels 44 and 46 are folded toward the center of the carton about fold lines 48 and 50, respectively. Sealing panel or tab 81 is rotated against the surface of main bottom panel 74, and corner panels 52 and 54 are simultaneously folded over to form partially formed carton 32 with bottom edge 66. Referring to FIGS. 2 and 3, there is illustrated the bottom end of a partially formed carton 32. The carton bottom can be sealed together by any suitable method, for example, by use of an adhesive, ultrasonic vibration, and most preferably hot fusion.

Specifically referring to FIG. 3A, partially formed carton 32 is divided into the five regions of varying thicknesses. A first region 33 is a striplike portion extending across the bottom of carton 32 through the center thereof and including two triangular second regions 34 at the midportion of its length, with their apexes butting against each other. Except for the second regions 34, the first region 33 has four layers of the container blank. Second regions 34 have two layers. Carton 32 has another region having four layers of carton blank, i.e., a third region 35 including sealing panel 81. Third region 35 partly includes a region 36 having two layers. Generally, triangular fourth regions 37 having three layers are present on opposite sides of first region 33. The remaining portions are fifth regions 39 having one layer of the blank.

Although described in conjunction with a conventional carton having rectangular wall panels, it should be understood that the present invention also is suitable for use, for example, with containers shaped as sections of round or curved cylinders, square cylinders (i.e., prisms having square cross-sections), rectangular cylinders (i.e., prisms having rectangular cross-sections), and cones and containers having four trapezoidal shaped wall panels, as well as other container configurations having various numbers, thicknesses and shapes of overlapping layers on the container bottom. Additionally, although a particular carton bottom configuration is illustrated in FIGS. 3 and 3A, the present invention is also suitable for use with various other bottom configurations including, for example, fin bottoms, rex bottoms, tuck bottoms, L bottoms, J bottoms, six panel bottoms, as well as other bottom configurations. The present invention is suitable for carton bottoms which are square, rectangular or any other shape.

As illustrated in FIG. 4, a carton bottom 34 is contoured and formed by compressing the carton bottom between a mandrel pad 12 and a seal plate 14. Mandrel pad 12 may be stationary and seal plate 14 pressed up against the exterior bottom surface of partially formed carton 32 by any suitable means, thereby compressing the carton bottom between mandrel pad 12 and seal plate 14, preferably while the layers comprising the bottom wall are hot and tacky. Alternatively, seal plate 14 may be rigidly attached to the carton forming machine. Mandrel pad 12, which partially formed carton 32 may be erected and folded around, can be pressed down to the interior top surface of the bottom of partially formed carton 32 by any suitable means, for example, by a reciprocating piston. Partially formed carton 32 is pressed between mandrel pad bottom of carton 32 into the shape of the gap between mandrel pad 12 and seal plate 14. Subsequently, mandrel pad 12 and seal plate 14 are separated from carton bottom 34 by suitable means. After bottom sealing, the carton may be filled and finally its top opening sealed.

As illustrated in FIGS. 5 and 6, carton bottom 34 is contoured so as to have carton legs 56. Carton legs 56 have an outside edge. 68 and an inside edge 70, which may be straight, curved or any other suitable shape. Carton legs 56 enable carton bottom 34 to stand upright on flat surface 75. Although it is preferable to form carton legs 56 parallel to bottom edge 66 to minimize the potential of leaking liquid products, carton legs 56 can be formed either perpendicular or parallel to bottom edge 66. Alternatively, the recessed region of carton bottom 34 may be both perpendicular and parallel to bottom edge 66, thereby forming four carton legs which are preferably of square cross-section.

In the preferred embodiment, the width of the recessed region between carton legs 56 at any position in the recessed region is greater than the sum of the widths of carton legs 56. Alternatively, the sum of the widths of carton legs 56 is less than half the width of the entire carton bottom. Additionally, the recessed region preferably encompasses substantially the entire center region having the maximum number of overlapping layers of material (i.e., width W in FIG. 3A with four overlapping layers for a standard L bottom carton), as well as a substantial portion of the bottom region outside the center region predominately having less than the maximum number of overlapping layers of material. Although preferable, carton legs 56 do not necessarily need to extend the entire length of carton bottom 34 so long as their length and width are sufficient to provide a stable bottom surface.

Figure 10:
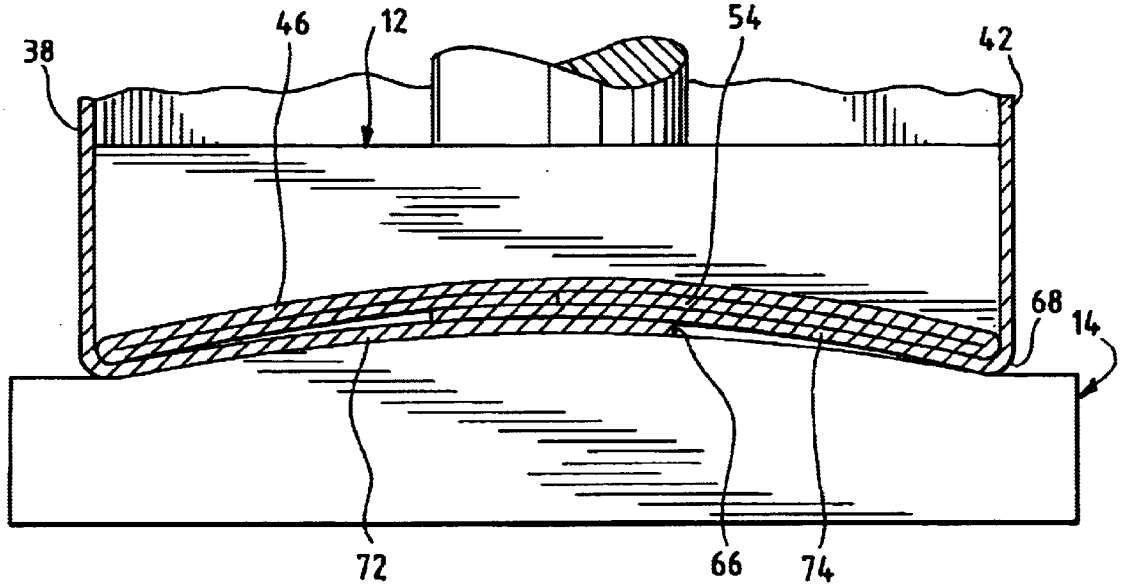
Figure 11:
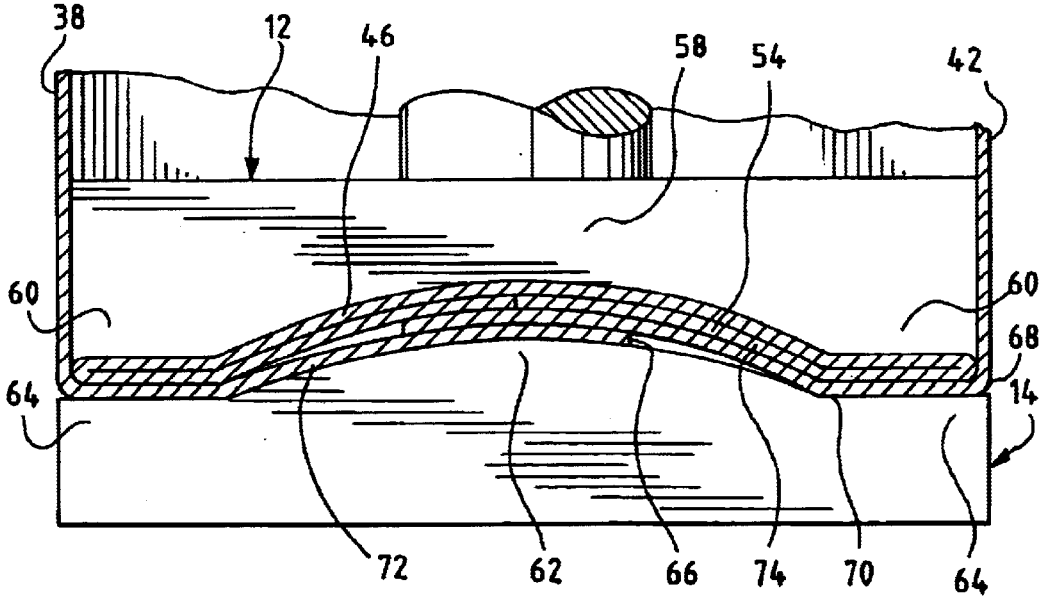

With reference to FIG. 7, mandrel pad 12 and seal plate 14 are composed of steel, or any material suitable to compress and contour the bottom of carton 32. Mandrel pad 12 contains recessed area 58 and extended areas 60. The corners defining recessed area 58 and extended areas 60 can be about 90°, but also may be other angles, or configurations. For example, the corners can be a continuous curve (as illustrated in FIGS. 10 and 11) or have a 45° chamfer. The depth of recessed area 58 varies depending upon, for example, the thickness and stiffness of the paperboard or other material used for the container, the weight of the product to be packaged in the container and the particular configuration of the carton bottom. Mandrel pad 12 can be in any shape or configuration which will provide for forming a stable container bottom, including, for example, a two legged carton bottom, a three legged carton bottom or a four legged carton bottom. Similarly, the legs 56 need not be rectangular or planar, but could be curved, triangular or some other shape, or have recessed portions facing toward the interior of the carton.

Referring again to FIG. 7, seal plate 14 is approximately complementary to mandrel pad 12, having a raised area 62 adapted to fit within recess 58 of mandrel pad 12, and recessed areas 64 adapted to receive extended areas 60 of mandrel pad 12. The surface of area 62 is preferably raised with respect to the surfaces of recessed areas 64 by approximately the same amount that recess 58 is offset from the surfaces of extended areas 60. The size and shape of leg forming area 64 is made to correspond to mandrel pad 12. Optionally, one or more of legs 56 may be formed with internally recessed regions. Accordingly, extended areas 60 and leg forming area 64 may have recessed and raised portions, respectively, to form such regions.

Mandrel pad 12 and seal plate 14 may contain additional recessed and raised areas to accommodate variations in the number of overlapping layers and/or their shape and/or thickness over the carton bottom, as is currently known in the art.

Figure 8:
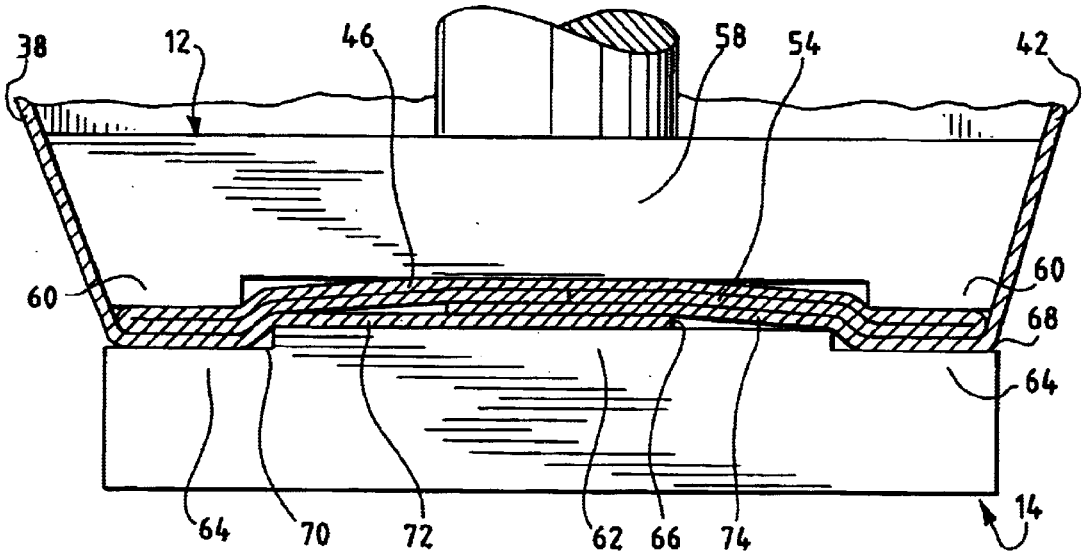
FIGS. 8, 9, 10, 11, 12 and 13 are cross-sectional views of alternative embodiments of the present invention.
Figure 9:
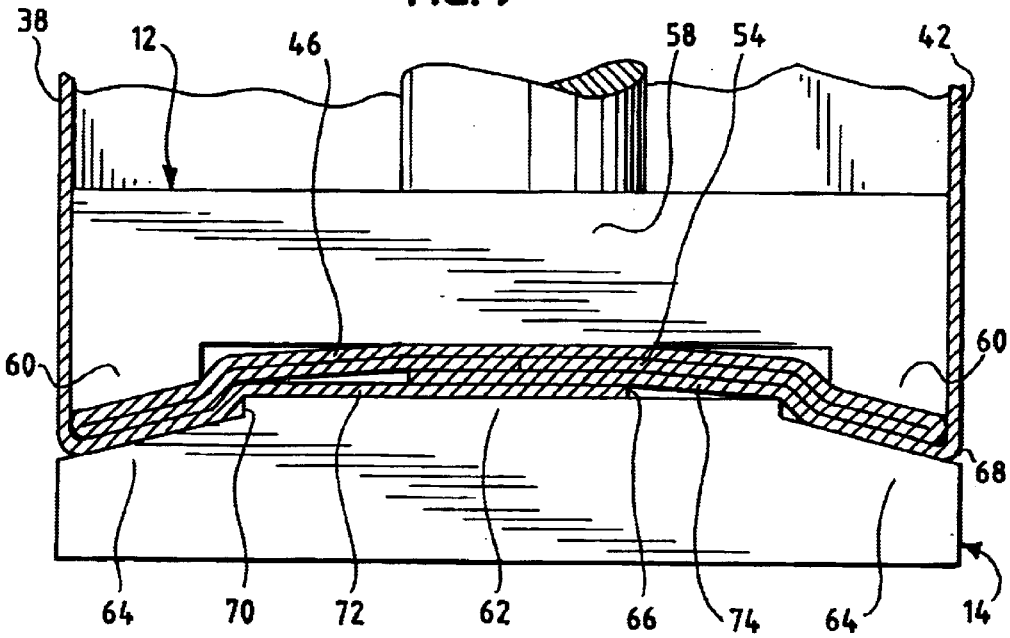
Figure 12:
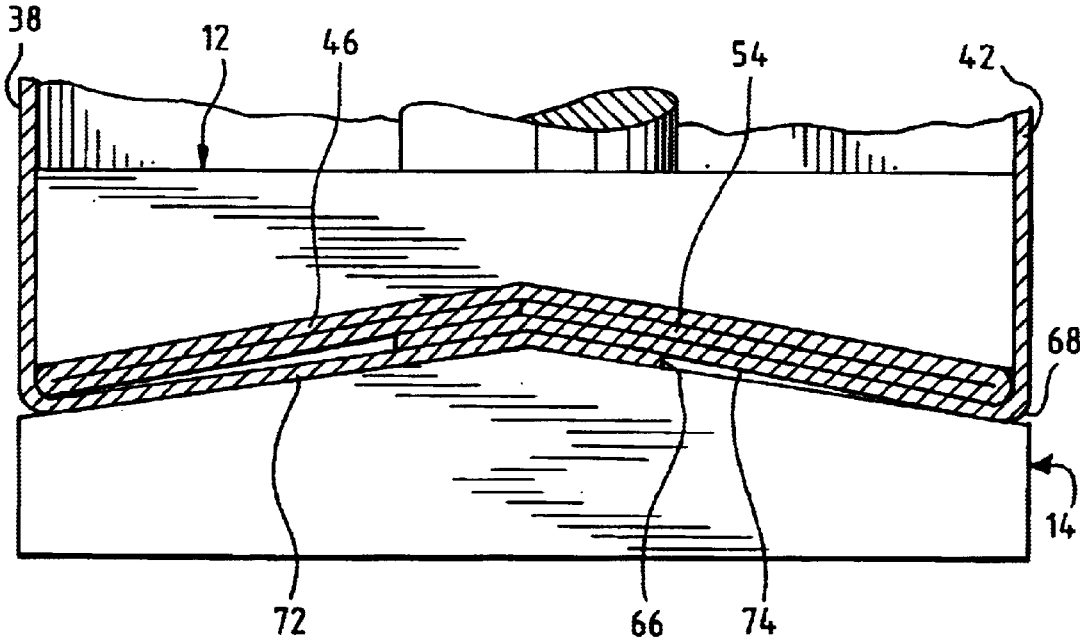
Figure 13:
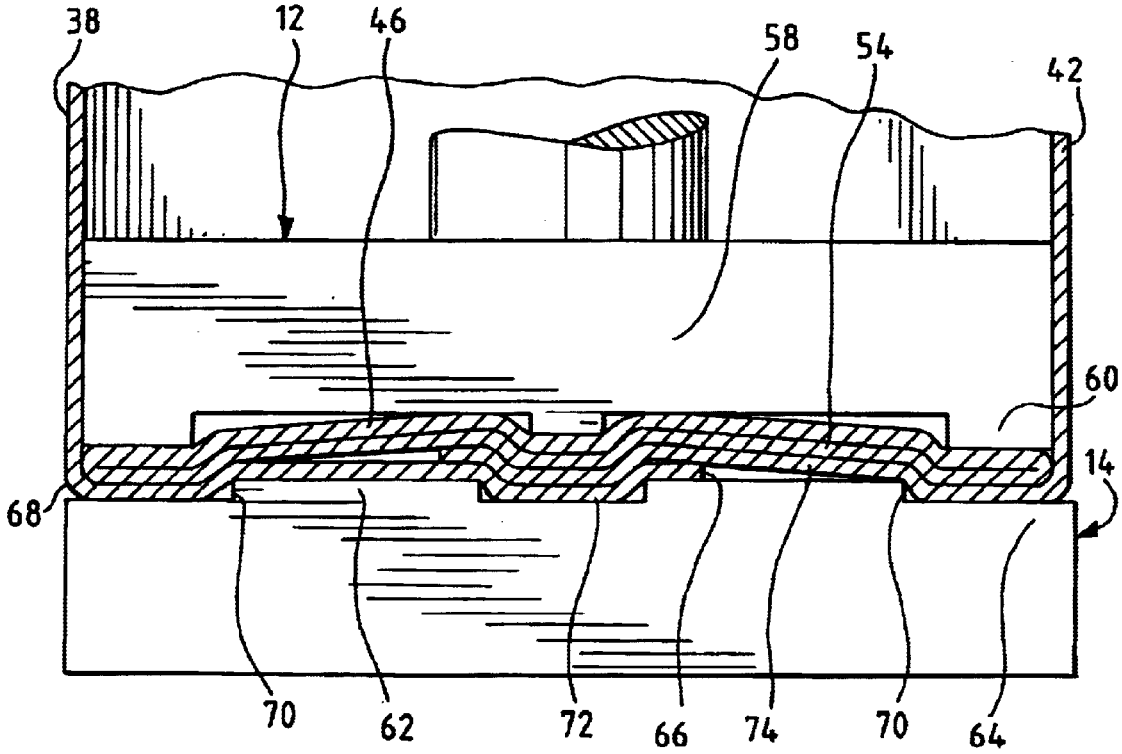

With reference to FIGS. 8, 9, 10, 11, 12 and 13, there are illustrated various alternative embodiments of the present invention. Like reference numerals correspond to reference numerals in FIG. 4. Specifically, FIG. 8 illustrates a tapered carton (which may be used, for example, as a beverage cup), and corresponding mandrel pad and seal plate. Referring to FIG. 9, there is shown a carton (and mandrel pad and seal plate) where the extended portions of carton legs 56 are not parallel to the recessed area. Although illustrated as substantially planar, carton legs 56 may be curved or any other suitable shape. Additionally, inside edge 70 may be raised more than outside edge 68. Referring to FIGS. 10 and 11, there are illustrated cartons which have a curved recessed portion. The curved recessed portion is preferably concave and may encompass all or some of the carton bottom. Referring to FIG. 12, there is shown a carton where the width of carton legs 56 are each approximately half of the width of the carton bottom. In this embodiment, each carton leg 56 may be substantially planar. Preferably, carton legs 56 encompass substantially all of the carton bottom and come together to form an obtuse angle. Referring to FIG. 13, there is illustrated a carton with three carton legs 56 arranged as three roughly equally spaced strips. The three legs 56 may be arranged in a triangular configuration or other configurations which allow for standing stability.

While the invention has been described with respect to certain preferred embodiments and, as will be appreciated by those skilled in the art, it is to be understood that the invention is capable of numerous changes, modifications and rearrangements and such changes, modifications and rearrangements are intended to be covered by the following claims.

I claim:

1. A carton composed of foldable material having first, second, third and fourth side panels, each side panel ending at a corresponding bottom panel, the bottom panels being folded and sealed so as to form a sealed carton bottom and to define an interior region of the carton, the exterior surface of the carton bottom having first and third bottom edges on opposite sides and at the periphery of the bottom between the first and third side panels and the corresponding bottom panels, the exterior surface of the sealed carton bottom also having second and fourth bottom edges on opposite sides and at the periphery of the bottom between the second and fourth side panels and the corresponding bottom panels, the first and third bottom edges being substantially perpendicular to the second and fourth bottom edges, such that the first, second, third and fourth bottom edges form the perimeter of the carton bottom, wherein the carton is formed from a blank having substantially straight score lines adjoining the carton bottom, and wherein the exterior surface of the sealed carton bottom comprises:

a first inclined surface lying substantially in a first plane;

a second inclined surface lying substantially in a second plane;

wherein said first and second planes intersect along a line of intersection, wherein a first end of said first inclined surface extends from substantially the entire length of said first bottom edge and a first end of said second inclined surface extends from substantially the entire length of said third bottom edge, wherein a first portion of each of said second and fourth bottom edges is located on said first inclined surface and a second portion of each of said second and fourth bottom edges is located on said second inclined surface, and wherein said line of intersection is disposed toward the interior region of the carton;

further comprising a third surface lying substantially in a horizontal plane and disposed towards the interior region of the carton, wherein said third surface is disposed between said first and second inclined surfaces.

2. The carton of claim 1 wherein said third surface extends from a portion of the length of said second bottom edge to a portion of the length of said fourth bottom edge and wherein said portions of said second and fourth bottom edges are located on said third surface.

3. A carton composed of foldable material and having a hollow body portion and attached bottom panels folded and sealed so as to form a sealed carton bottom, thereby defining an interior region of a carton, the exterior surface of the stable sealed carton bottom having first and third bottom edge portions on opposite sides of the bottom, the exterior surface of the sealed carton bottom also having second and fourth bottom edge portions on opposite sides of the bottom, the first and third bottom edge portions being substantially perpendicular to the second and the fourth bottom edge portions, such that the first, second, third and fourth bottom edge portions lie on the perimeter of the carton bottom, wherein the exterior surface of the sealed carton bottom comprises:

a first inclined surface lying substantially in a first plane;

a second inclined surface lying substantially in a second plane;

a third surface lying substantially in a third, horizontal plane and being disposed towards the interior region of the carton;

wherein said first and second planes intersect said third, horizontal plane along first and second lines of intersection, respectively, wherein a first end of said first inclined surface extends from substantially the entire length of said first bottom edge portion and a first end of said second inclined surface extends from substantially the entire length of said third bottom edge portion, wherein said third, horizontal surface is disposed between said first and second inclined surfaces, and wherein a first portion of said second bottom edge portion and a first portion of said fourth bottom edge portion are located on said third surface.

4. The carton of claim 3 wherein a second end of said first inclined surface intersects said third surface along said first line of intersection and a second end of said second inclined surface intersects said third horizontal surface along said second line of intersection.

5. The carton of claim 3 wherein a second portion of said second bottom edge portion and a second portion of said fourth bottom edge portion are located on said first inclined surface, and wherein a third portion of said second bottom edge portion and a third portion of said fourth bottom edge portion are located on said second inclined surface.

* * * * *